US010085912B2

(12) United States Patent
Rohr et al.

(10) Patent No.: US 10,085,912 B2
(45) Date of Patent: Oct. 2, 2018

(54) INDEPENDENTLY ADJUSTABLE AIR BLADDERS HAVING AIR FILLED FIRMNESS FOR AN ENCLOSURE

(71) Applicant: L&P PROPERTY MANAGEMENT COMPANY, South Gate, CA (US)

(72) Inventors: William Robert Rohr, Joplin, MO (US); Vinod Kumar Gopalakrishnan, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 475 days.

(21) Appl. No.: 14/755,573

(22) Filed: Jun. 30, 2015

(65) Prior Publication Data

US 2017/0000685 A1 Jan. 5, 2017

(51) Int. Cl.

| | |
|---|---|
| ***A47C 27/08*** | (2006.01) |
| ***A61H 9/00*** | (2006.01) |
| ***A47C 21/00*** | (2006.01) |
| ***A47C 27/10*** | (2006.01) |
| *A61H 23/00* | (2006.01) |

(52) U.S. Cl.

CPC ..... *A61H 9/0078* (2013.01); *A47C 21/006* (2013.01); *A47C 27/082* (2013.01); *A47C 27/083* (2013.01); *A47C 27/10* (2013.01); *A61H 23/006* (2013.01); *A61H 2201/0103* (2013.01); *A61H 2201/0146* (2013.01); *A61H 2201/0192* (2013.01); *A61H 2201/1409* (2013.01); *A61H 2201/5007* (2013.01); *A61H 2201/5038* (2013.01); *A61H 2201/5071* (2013.01); *A61H 2230/80* (2013.01)

(58) Field of Classification Search

CPC ..... A47C 27/082; A47C 27/08

USPC ..... 5/615, 713, 722

See application file for complete search history.

(56) References Cited

U.S. PATENT DOCUMENTS

| | | | | |
|---|---|---|---|---|
| 4,839,932 | A * | 6/1989 | Williamson | A47C 20/048 5/615 |
| 5,020,176 | A | 5/1991 | Dotson | |
| 6,317,912 | B1 | 11/2001 | Graebe et al. | |

(Continued)

OTHER PUBLICATIONS

International Search Report and Written Opinion dated Sep. 16, 2016 for International Patent Application No. PCT/US2016/039733, 11 pages.

*Primary Examiner* — Fredrick C Conley

(74) *Attorney, Agent, or Firm* — Shook, Hardy & Bacon L.L.P.

(57) ABSTRACT

An adjustable air bladder apparatus is provided. The apparatus includes an outer enclosure, a first interior section within the outer enclosure that contains a plurality of air bladders, a second interior section within the outer enclosure that contains a support layer, and an air pump pneumatically coupled to the plurality of air bladders, where the air pump is configured to selectively supply pressurized air to the air bladders independently through a pneumatic coupling. The pneumatic coupling includes one or more supply valves, outlet valves, and pressure sensors coupled to each air bladder or to one or more groupings of air bladders. A control device is provided for monitoring the pressure within the air bladders and for controlling an amount of air provided to or released from the bladders or groupings of bladders. A method of providing rolling massage with the apparatus is also disclosed.

21 Claims, 7 Drawing Sheets

(56) References Cited

U.S. PATENT DOCUMENTS

| | | | | |
|---|---|---|---|---|
| 6,336,907 | B1 | 1/2002 | Dono et al. | |
| 6,739,005 | B2 * | 5/2004 | Davis | A47C 20/048 5/613 |
| 7,346,951 | B1 * | 3/2008 | Heaton | A61G 7/008 5/615 |
| 2003/0188387 | A1 * | 10/2003 | Leventhal | A47C 20/048 5/660 |
| 2005/0125905 | A1 | 6/2005 | Wilkinson | |
| 2005/0155154 | A1 * | 7/2005 | Kasatshko | A47C 4/54 5/713 |
| 2008/0117488 | A1 | 5/2008 | Nanjyo et al. | |
| 2012/0036646 | A1 | 2/2012 | McCausland et al. | |
| 2014/0223665 | A1 | 8/2014 | Chapin | |
| 2015/0007393 | A1 | 1/2015 | Palashewski | |

* cited by examiner

INDEPENDENTLY ADJUSTABLE AIR BLADDERS HAVING AIR FILLED FIRMNESS FOR AN ENCLOSURE

CROSS-REFERENCE TO RELATED APPLICATIONS

Not applicable.

STATEMENT REGARDING FEDERALLY SPONORED RESEARCH OR DEVELOPMENT

Not applicable.

TECHNICAL FIELD

The present invention relates to adjustable air bladders having air filled firmness which can be independently adjusted inside an enclosure to raise and lower different sections of the enclosure in a controlled fashion to provide customized massage.

BACKGROUND OF THE INVENTION

Automated and adjustable articulating beds or furnishings are increasing in popularity and use. In a typical adjustable bed or furnishing item, a base with a series of connected panels that form an adjustable deck is moved into a variety of positions using mechanisms, pistons, and/or other mechanical components which are coupled to the adjustable deck. In addition, some bedding applications have a massage feature. In the typical massage application, a vibratory motor is connected to the decking to vibrate the mattress. It is increasingly desirable to have more control of the massage features of an adjustable bed or furnishing item to provide enhanced comfort and functionality for a user. Accordingly, a need exists for a reliable adjusting and massaging apparatus for an enclosure which addresses the foregoing, and other problems.

BRIEF SUMMARY

A high level overview of various aspects of the invention is provided here for that reason, to give an overview of the disclosure, and to introduce a selection of concepts that are further described below in the detailed-description section. This summary is not intended to identify key features or essential features of the claimed subject matter, nor is it to be used as an aid in isolation to determine the scope of the claimed subject matter. The scope of the invention is defined by the claims.

In brief, and at a high level, an apparatus is provided that includes a plurality of air bladders that can be independently filled and emptied of air inside an enclosure to increase or decrease the size of the air bladders to control the height of various portions of the enclosure. The apparatus may be incorporated into an enclosure that includes traditional support materials, such as springs or air chambers, or that incorporates a flat deck or a mechanically adjustable deck.

Generally, the apparatus includes an outer enclosure, which may be a mattress, chair, vehicle furnishing, office furnishing, or other type of enclosure. The outer enclosure may include a first interior portion that contains one or more adjustable air bladders and a second interior portion that contains a support layer. The support layer may include traditional support components that provide cushioning for the enclosure, such as spring coils, air chambers, foam, or other support materials. The first and the second interior sections may be separated by a protective layer (e.g., a dividing barrier) to segment the sections. The apparatus may include an air pump pneumatically coupled to the one or more adjustable air bladders and configured to selectively provide pressurized air to the one or more adjustable air bladders to increase the volume and pressure of the air bladders and the corresponding size of the air bladders. The air bladders may be coupled to the air pump such that the air bladders, or groupings of air bladders, may be filled independently with air from the air pump to vary the height and angle of the enclosure at that location, providing an upward force to the occupant. By selectively varying the pressure in the air bladders, a massaging feature is provided.

The one or more adjustable air bladders may be arranged into one or more groupings of air bladders positioned under different sections of the top of the enclosure. The air bladders may be on top of the support layer, just beneath the top of the enclosure. Each grouping may contain one or more air bladders that are pneumatically joined, and the air bladders may be in a stacked configuration such that when they are inflated, the bladders expand upward, raising a surface of the enclosure, and when they are deflated, the bladders flatten, lowering the surface of the enclosure.

Each grouping of air bladders may be pneumatically coupled to the air pump with individual pneumatic couplings so that each grouping of air bladders can be filled with pressurized air from the air pump independently and selectively, giving maximum control of the height and angle of various portions of the enclosure. The air pump may be pneumatically coupled to each grouping of air bladders with a supply valve, such as a one-way check valve, that allows control of the supply of pressurized air from the pump to each grouping of air bladders. The air bladders in each grouping may further be pneumatically coupled to an outlet valve that allows selective release of pressurized air from each grouping of air bladders to decrease the pressure and volume of the air bladders, changing the height and angular orientation of the outer enclosure, and allowing a customized, controllable massage function.

Each bladder grouping may include a sensor for monitoring air pressure within the corresponding grouping of air bladders (or individual air bladders, if each grouping contains only one bladder). Additionally, a control device may be provided for controlling and monitoring the amount of air within each grouping of air bladders. The control device may be configured to receive, process, and display an indication of pressure within each grouping of air bladders. The control device may also be communicatively coupled to the air pump, the supply valves, and the outlet valves such that a user can control each of the air pump, the supply valves, and the outlet valves to control an amount of pressurized air provided to each grouping of air bladders, and an amount of air released from each grouping of air bladders, to allow a user to control the height of various parts of the outer enclosure through expansion and contraction of the air bladders. In this respect, independent air bladder control within the outer enclosure allows a user to customize the massage function of the outer enclosure as desired.

In a first embodiment, an adjustable air bladder apparatus is provided. The apparatus comprises an outer enclosure, a first interior section within the outer enclosure that contains a plurality of air bladders, a second interior section within the outer enclosure that contains a support layer, and an air pump pneumatically coupled to the plurality of air bladders with at least one pneumatic coupling, wherein the air pump can independently supply pressurized air to first and second groupings of the plurality of air bladders, respectively.

In a second embodiment, an adjustable air bladder apparatus is provided. The apparatus comprises an outer enclosure, a first interior section within the outer enclosure that contains a plurality of air bladders, a second interior section within the outer enclosure that contains a support layer, and an air pump pneumatically coupled to the plurality of air bladders, wherein the plurality of air bladders are segmented into a plurality of groupings with each grouping having an independent pneumatic connection with the air pump, and wherein the air pump is configured to selectively supply pressurized air to each of the plurality of groupings through the respective independent pneumatic connections to raise and lower different portions of the enclosure to provide a massaging feature.

In a third embodiment, a method of providing rolling massage is provided. The method comprises providing an outer enclosure having a first interior section that contains a plurality of air bladders and a second interior section that contains a support layer, providing an air pump pneumatically coupled to a first grouping of the plurality of air bladders and separately pneumatically coupled to a second grouping of the plurality of air bladders, respectively, the first grouping located beneath a first portion of the outer enclosure, the second grouping located beneath a second portion of the outer enclosure, filling the first grouping with air from the air pump and subsequently releasing air from the first grouping through an outlet valve pneumatically coupled to the first grouping to raise and lower the first portion of the outer enclosure, and filling the second grouping with air from the air pump and subsequently releasing air from the second grouping through an outlet valve pneumatically coupled to the second grouping to raise and lower the second portion of the outer enclosure.

In a fourth embodiment, an adjustable air bladder apparatus is provided. The apparatus comprises an outer enclosure, a first interior section within the outer enclosure that contains a plurality of air bladders, a second interior section within the outer enclosure that contains a support layer, and an air pump, wherein the air pump is pneumatically coupled to a first grouping of the plurality of air bladders that are positioned in a first area of the enclosure and pneumatically coupled to a second grouping of the plurality of air bladders that are positioned in a second area of the enclosure, wherein the air pump is configured to selectively supply pressurized air to the first grouping to expand the first grouping and raise the first area of the outer enclosure and is configured to selectively supply pressurized air to the second grouping to expand the second grouping and raise the second area of the outer enclosure, and wherein the supply of pressurized air is adjustable to vary the speed at which the first and the second groupings are expanded.

The term "outer enclosure" as used herein may encompass mattresses and chairs, as well as home, vehicle, and office furnishings, among other enclosures which may be fitted, positioned, or coupled to a deck or an adjustable deck, and with which varying pressure and massage functionality is desired. Additionally, as described herein, pneumatically coupling an air pump to air bladders within an enclosure may include separately pneumatically coupling the air pump to each individual air bladder, separately pneumatically coupling the air pump to groupings of two or more air bladders, or pneumatically coupling the air pump to all of the air bladders, or having a selective combination thereof.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

The subject matter of select embodiments of the present invention is described with specificity in this disclosure to meet statutory requirements. However, the description itself is not intended to limit the scope of the invention. The claimed subject matter may be embodied in other ways to include different features, components, steps, or combinations of steps, similar to the ones described in this disclosure, and in conjunction with other present and future technologies. The term "step" should not be interpreted as implying any particular order among or between steps unless and except the order of individual steps is explicitly required.

Figure 1:
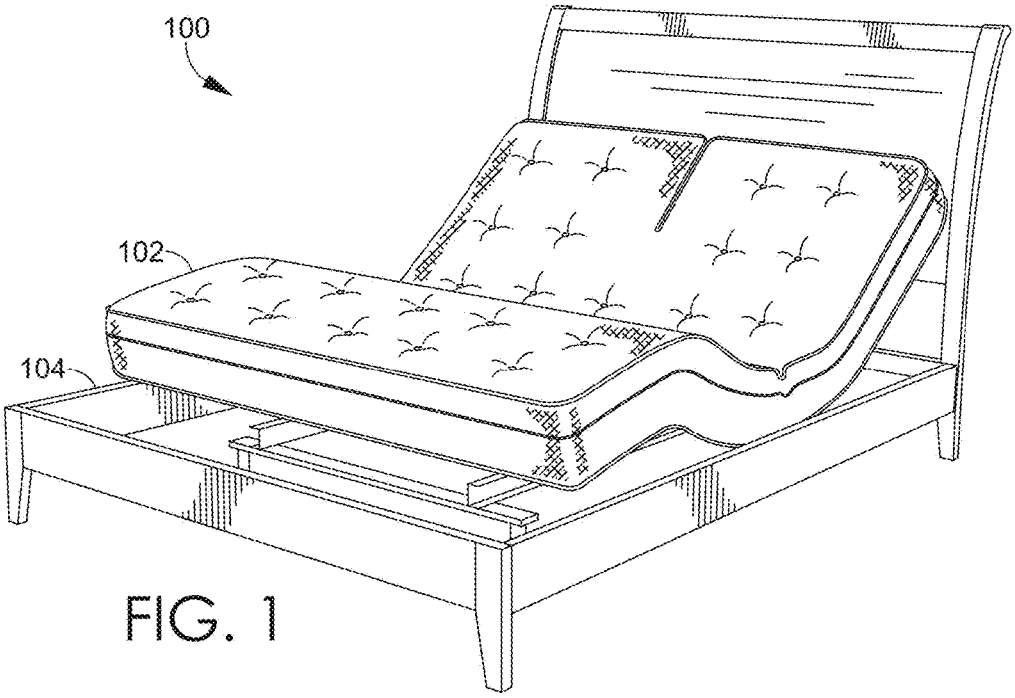
FIG. 1 is a perspective view of an exemplary adjustable bed including a mattress and a base, in accordance with an embodiment of the present invention.
Figure 2:
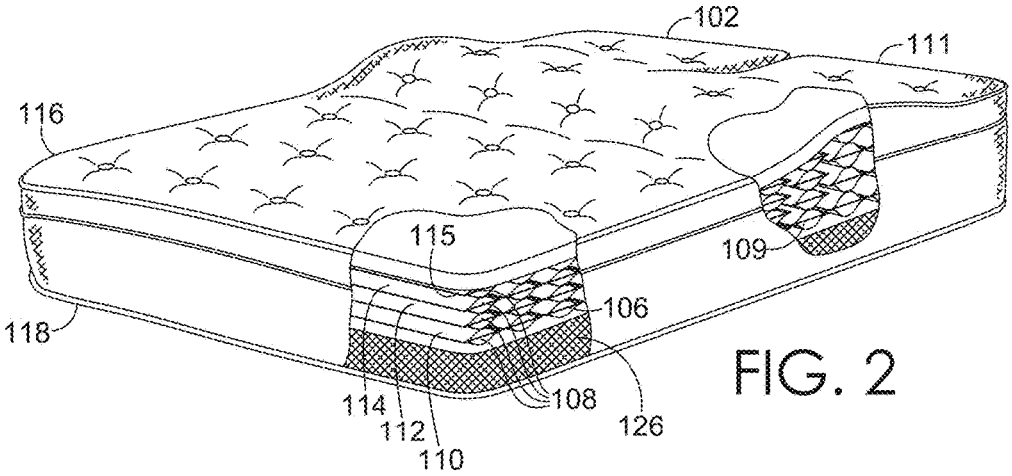
FIG. 2 is a cut-out perspective view of the mattress of FIG. 1, the mattress containing a plurality of adjustable air bladders, in accordance with an embodiment of the present invention.

In reference to FIGS. 1 and 2, an embodiment of an exemplary adjustable bed 100 including an outer enclosure 102 and a base 104, with one or more independently adjustable air bladders in an interior section of the enclosure 102, is shown, in accordance with an embodiment of the present invention. FIGS. 1 and 2 depict the enclosure 102 as a mattress, but different enclosures are possible and contemplated, as described in this disclosure. In reference to FIG. 2, the enclosure 102 is shown with cut-away sections that reveal multiple air bladders 106 located within the enclosure 102, the air bladders 106 in stacked configurations 108 on top of a support layer 126. The support layer 126 and the air bladders 106 are between a top 116 and a bottom 118 of the enclosure 102. The stacked configurations 108 shown in FIG. 2, which are but one exemplary arrangement of the air bladders 106, include first, second, third, and fourth air bladders 110, 112, 114, 115 stacked vertically on top of each other inside the enclosure 102 between the top 116 and the support layer 126. Each air bladder 106, or each stack of air bladders 108, may be independently pneumatically coupled to an air pump which is configured to selectively provide pressurized air to the individual air bladders 106 or to each grouping 108 of air bladders 106 to fill the air bladders 106 and raise and lower different areas of the top 116 of the enclosure 102. In this respect, the raising and lowering of different sections of the top of the enclosure may be initiated to provide customized massage for a person laying on the enclosure (e.g., a rolling massage, targeted percussive massage, random massage, etc.), or for raising and lowering different parts of the person's body.

The air pump may be located inside or outside of the enclosure 102, and may be pneumatically coupled to the bladders 106, or to each grouping 108 of bladders 106, with a pneumatic coupling which may include one or more supply valves for individually controlling the supply of pressurized air to the bladders 106 or to the groupings of bladders 108. Each bladder 106 or bladders 108 may include an associated outlet valve for releasing air pressure from the bladders 106 or groupings of bladders 108. Each of the components, except the air bladders which must generally be inside the enclosure, may be housed inside or outside of the enclosure. The air bladders 108 may be used with a flat mattress with a deck or in an adjustable mattress with an adjustable deck to provide articulation and massage functionality simultaneously. Additionally, the adjustable air bladders may be used in conjunction with an air mattress that contains pumps, pneumatic connections, and controls for controlling the firmness of an air-based support layer, with the air bladders used for providing additional articulation and massage functions. In this regard, the air bladders may be integrated with the pneumatic components of a traditional air mattress, to simplify construction and reduce production cost.

In the stacked grouping 108 shown in FIG. 2, each air bladder 106 or each grouping 108 of air bladders 106 may have an independent pneumatic coupling with the air pump, including a supply valve and an outlet valve. In this regard, the air pump, supply valves, and outlet valves can be operated to control an amount of pressurized air in each air bladder 106 or in each grouping 108 of air bladders 106, depending on how the air bladders are joined or segmented pneumatically. Air can be provided through the supply valves and released through the outlet valves to fill and empty the bladders 106. When the air bladders 106 are filled with air in a particular section of the outer enclosure 102, that section of the outer enclosure 102 will elevate. As shown in FIG. 2, the air bladders 109 towards one end 111 of the enclosure 102 are inflated, raising part of the enclosure 102. The air used to inflate the air bladders 109 may then be released from the air bladders 109 through one or more outlet valves, lowering the section. This can be repeatedly actuated to provide a massage function.

The increase or decrease of air pressure in the air bladders 106 may be controlled or monitored in any number of ways, including with pressure sensors that detect pressure in the bladders 106 or groupings 108 of bladders 106 and send the pressure readings to a control or monitoring device, or in response to user input at a manual control device. In this regard, the control device may be used to control the amount of pressurized air within the bladders 106 or the groupings of bladders 108. It should be noted that the air bladder configuration in FIG. 2 is merely exemplary. Any number, density, size, or cross-sectional configuration of air bladders may be used, and a grouping of air bladders may include any combination of air bladders, including a single air bladder, one or more air bladders in a stacked or segmented grouping, or multiple air bladder stacks forming bladder zones in different portions of the enclosure.

Figure 3:
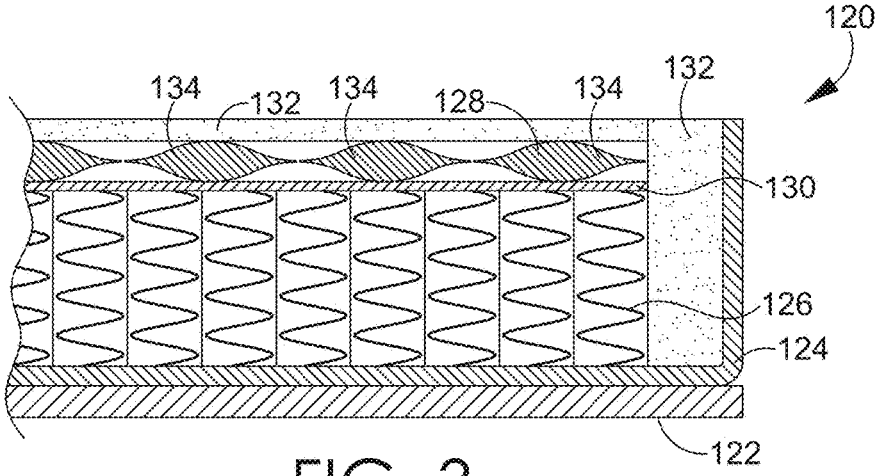
FIG. 3 is a side cut-away view of an enclosure containing a plurality of adjustable air bladders, in accordance with an embodiment of the present invention.

In reference to FIG. 3, a side cut-away view of a mattress 120 having multiple interior compartments is shown, in accordance with an embodiment of the present invention. In FIG. 3, the mattress 120 includes a deck 122, which in embodiments may be flat, adjustable, and/or segmented, that provides support for the mattress 120. The mattress 120 further includes a containment cover 124 for protecting the interior components of the mattress 120. The mattress 120 further includes a support layer 126, which in FIG. 3 is a plurality of pocketed spring coils, for providing dynamic support for the mattress 120, and an air bladder layer 128 separated from the support layer 126 by a protective layer 130 that prevents damage to air bladders 134 within the air bladder layer 128. The air bladders 134 may be formed from sheets of flat material joined together, and may have relatively flat edges to allow the air bladders to lay flat in a deflated state. A foam comfort layer 132 is provided on top of the mattress 120 and on sides of the mattress 120. The air bladder layer 128 includes the multiple air bladders 134 which may be independently filled with pressurized air using an air pump pneumatically coupled to each air bladder 134 with a supply valve (e.g., a one way-check valve). Each air bladder 134 may also include an outlet valve pneumatically coupled to each air bladder 134 for releasing pressurized air from the bladders 134. Additionally, each air bladder 134 may include a pressure sensor configured to send pressure signals to a control/monitoring device. The control/monitoring device may be a wireless tablet, smart device, touch-screen controller, adjustable tablet, remote sensing device, or smart device comprising a modular programmable microprocessing unit electrically or wirelessly connected (e.g., using Bluetooth) to the bladders 134, to provide control of the height or angular orientation of different portions of the mattress 120. In one embodiment, the air bladders 134 may be formed from two sheets of material joined together, such as by stitching, adhesives, heat or ultrasonic welding, or another joining method, such that in a deflated state, the air bladders 134 lay flat, and in an inflated state, they bulge upward, as shown in FIG. 3.

Figure 4:
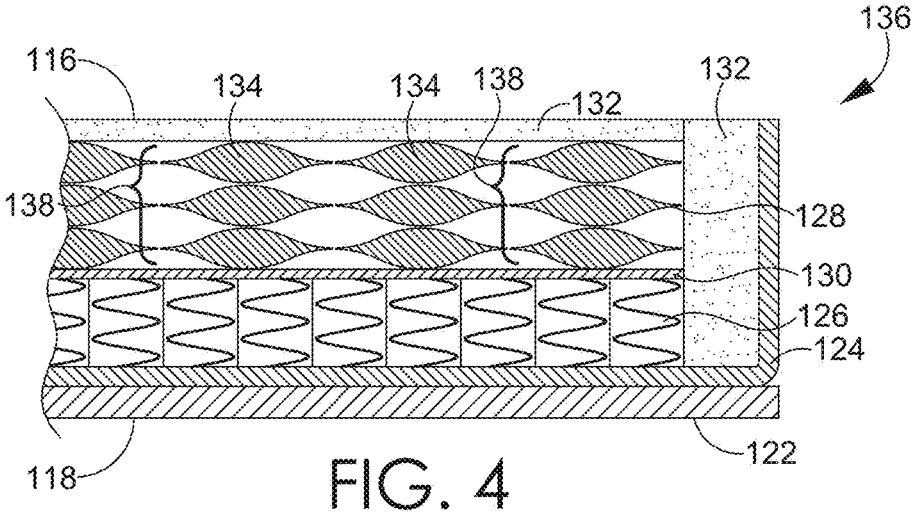
FIG. 4 is a side cut-away view of an enclosure containing multiple stacked groupings of adjustable air bladders, in accordance with an embodiment of the present invention.

In reference to FIG. 4, a side cut-away view of a mattress 136 having air bladders 134 arranged into stacked groupings 138 is shown, in accordance with an embodiment of the present invention. The mattress 136 includes the deck 122 which may be adjustable, the containment cover 124, the protective layer 130, the air bladder layer 128, and the foam comfort layer 132, as described in relation to FIG. 3. Additionally, the air bladder layer 128 includes multiple air bladders 134 arranged into the multiple stacked groupings 138, with each grouping 138 having three air bladders 134 stacked on top of each other inside the mattress 136 above the support layer 126. As described herein, the air bladders 134 and/or the stacked groupings 138 of air bladders 134 may be independently pneumatically coupled to a supply valve, an outlet valve, and an air pump. In this regard, by operating the air pump, as well as the supply valves and the outlet valves associated each individual bladder 134, or alternatively if the air bladders 134 in each grouping 138 are pneumatically joined and share the same air pressure, the stacked groupings 138 of air bladders 134, the air bladders 134 may be filled and emptied of pressurized air to raise and lower the top surface 116 of the mattress 136, or adjust the angular orientation of the top surface 116 of the mattress 136. Any arrangement of air bladders, including varying numbers, sizes, shapes, orientations, or combinations of air bladders, is possible within an outer enclosure, such as the mattress 136, depending on the desired amount of cushion, control, or articulation of the outer enclosure.

Figure 5:
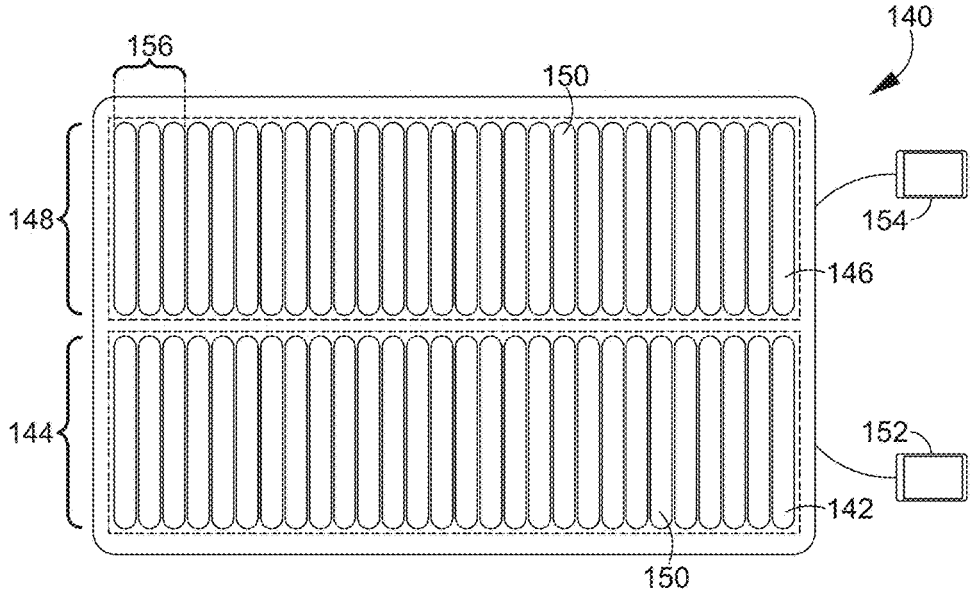
FIG. 5 is a top elevation view of a mattress having multiple adjustable sections with independently adjustable air bladders within each section, in accordance with an embodiment of the present invention.

In reference to FIG. 5, a top elevation view of a mattress 140 having multiple adjustable sections with independently adjustable groupings of air bladders within each section is shown, in accordance with an embodiment of the present invention. In FIG. 5, a mattress 140 is shown having a first air bladder section 142 under a first half 144 of the mattress 140 and a second air bladder section 146 under a second half 148 of the mattress 140. In this regard, the mattress 140 includes the independently controllable air bladder sections 142, 146 that allow customized height, angular adjustment, and rolling massage of each half 144, 148 of the mattress so that first and second users who lay on the respective halves 144, 148 of the mattress 140 can customize the position, orientation, and massage features of their respective half 144, 148 of the mattress 140. Additionally, the air bladders 150 in each half 144, 148 of the mattress 140 may be independently pneumatically coupled to an air pump with a supply valve for filling the air bladders 150 with pressurized air, to raise areas of the mattress 140 corresponding to the individual locations of the air bladders 150. The air bladders 150 may include one or more outlet valves pneumatically coupled to the air bladders 150 to allow pressurized air to be released from the air bladders 150. The air bladders 150 may be arranged into one or more groupings, including vertical stacked groupings, such as the vertical stacked grouping 108 shown in FIG. 2, that includes multiple air bladders 150 that are pneumatically joined together and also pneumatically coupled to an outlet valve and to an air pump via a supply valve, such that each grouping can be filled or emptied to raise and lower the grouping, and consequently, raise and lower the corresponding section of the mattress 140. Each bladder 150 may include one or more pressure sensors for providing air pressure measurements to a control device or feedback device. In an embodiment, the bladders 150 in each half 144, 148 of the mattress may be inflated and deflated in rolling sequence from one end of the mattress 140 to the other to provide rolling massage. Any type of support component, such as coil springs, an air chamber, or foam may be included under the bladders 150, and the mattress 140 may include a flat deck or an adjustable deck.

Further in FIG. 5, each air bladder section 142, 146 may be controlled by a first and a second controller 152, 154 which independently control an outlet valve, air pump, and supply valve associated with bladders 150 in each respective bladder section 142, 146 to provide independent adjustment of each bladder section 142, 146 in the first and the second halves 144, 148 of the mattress 140. The air bladders 150 within each air bladder section 142, 146 may be pneumatically segmented or grouped depending on the desired amount of control of the mattress 140. Maximum control is provided when the air pressure within each individual air bladder 150 is controlled independently, but multiple air bladders 150 in each air bladder section 142, 146 may be pneumatically joined to form different zones for more segmented control on each half 144, 148 of the mattress 140. FIG. 5 shows one such exemplary zone 156, but different combinations of air bladders 150 (e.g., stacked versus horizontal combinations; many bladders versus one or a few) are possible and contemplated. Additionally, in various embodiments of the invention, independent zone control (head, lumbar, thigh, etc.) is possible with customized segmentation of the air bladders across the enclosure, to allow for targeted massage through independent control of each zone.

Figure 6:
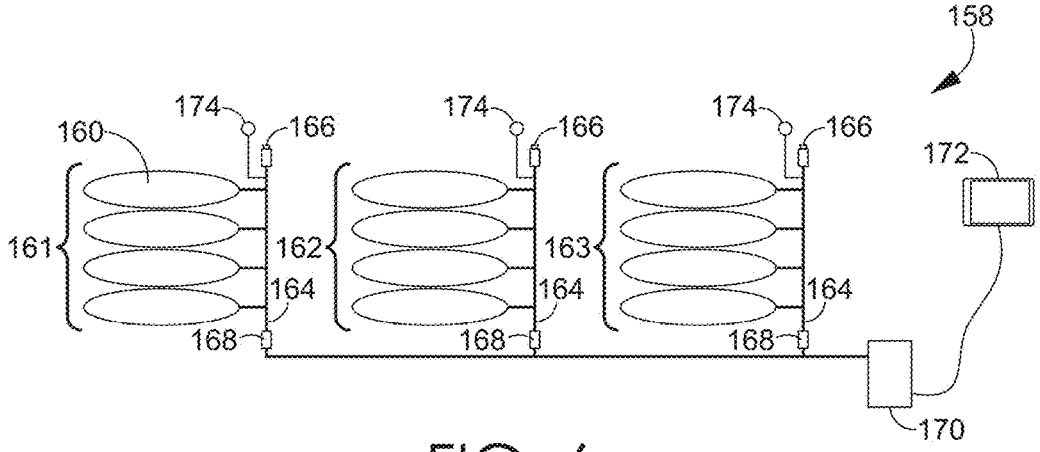
FIG. 6 is an exemplary configuration of an apparatus for adjusting the height and angular orientation of an enclosure, in accordance with an embodiment of the present invention.

In reference to FIG. 6, an exemplary schematic configuration of an apparatus 158 for adjusting the height and angular orientation of an enclosure is shown, in accordance with an embodiment of the present invention. In FIG. 6, the apparatus 158 includes multiple air bladders 160 which are grouped into multiple stacked groupings 161, 162, 163, with the air bladders 160 in each grouping 161, 162, 163 pneumatically coupled with an interlinking pneumatic coupling 164 that allows the air bladders 160 in each grouping 161, 162, 163 to share the same air pressure. In this configuration, when a supply of pressurized air is provided through the interlinking pneumatic couplings 164 to each grouping 161, 162, 163, the air bladders 160 in each grouping 161, 162, 163 increase in pressure, and in volume, together, to raise at least a portion of an enclosure within which the bladders 160 are located. Additionally, each interlinking pneumatic coupling 164 includes an outlet valve 166 for selectively releasing pressurized air from the bladders 160 in each grouping 161, 162, 163 and a supply valve 168 for selectively providing pressurized air from an air pump 170 to fill bladders 160 in each grouping 161, 162, 163. The air bladders 160 may be constructed of an expandable material that allows expansion and contraction of the air bladder 160 volume in response to varying amounts of air pressure to increase and decrease upward pressure on a top surface of the enclosure, and/or to raise and lower sections of the enclosure, or adjust the angle of the enclosure. Additionally, while three groupings of air bladders are shown for simplicity in FIG. 6, in practice, a variety of groupings or number of air bladders per grouping is possible and contemplated depending on the size of the enclosure used for a mattress, furniture, or other item.

In FIG. 6, a control device 172 is also provided for receiving feedback from pressure sensors 174 coupled to each air bladder grouping 161, 162, 163 and providing such feedback to a user of the apparatus. The control device 172 is configured to control the amount of pressurized air in each air bladder grouping 161, 162, 163 to provide varying heights and angular orientations of a surface of an enclosure within which the apparatus 158 is positioned. The control device 172 may be electrically or wirelessly coupled to the air pump 170, supply valves 168, outlet valves 166, and sensors 174, for independent monitoring and control of the amount of air pressure in each of the groupings 161, 162, 163 of air bladders 160. Again, each grouping may be one or more air bladders 160, depending on the desired amount of adjustability.

The control device 172 may also be configured to receive feedback from the pressure sensors 174 and indicate an amount of air pressure within each bladder grouping 161, 162, 163. The inflation and deflation of each stacked grouping 161, 162, 163 of the air bladders 160 may be directed by an external circuit that provides variable expansion of individual bladders 160, bladder groupings 161, 162, 163, and bladder zones which comprise multiple bladder groupings 161, 162, 163. The adjustment of the inflation of the bladder groupings 161, 162, 163 may be accomplished automatically, such as, for example, in response to receiving an indication from a user to provide rolling massage, at which point the control device will automatically inflate and deflate the bladder sections to articulate and elevate an enclosure in a preprogrammed movement pattern.

Adjustment of pressure levels in the bladders 160 may also occur in response to sensed occupancy and operating conditions. The control circuit may include a singular or series of adjustable enclosure capacitance sensors that communicate with a programmed microprocessor. The capacitance sensors supply occupancy information to the microprocessor which may in turn direct the filling and emptying of the bladder groupings 161, 162, 163, or filling and emptying of different bladder zones comprising multiple stacked groupings, to provide an optimum fill state for the bladders 160.

Figure 7:
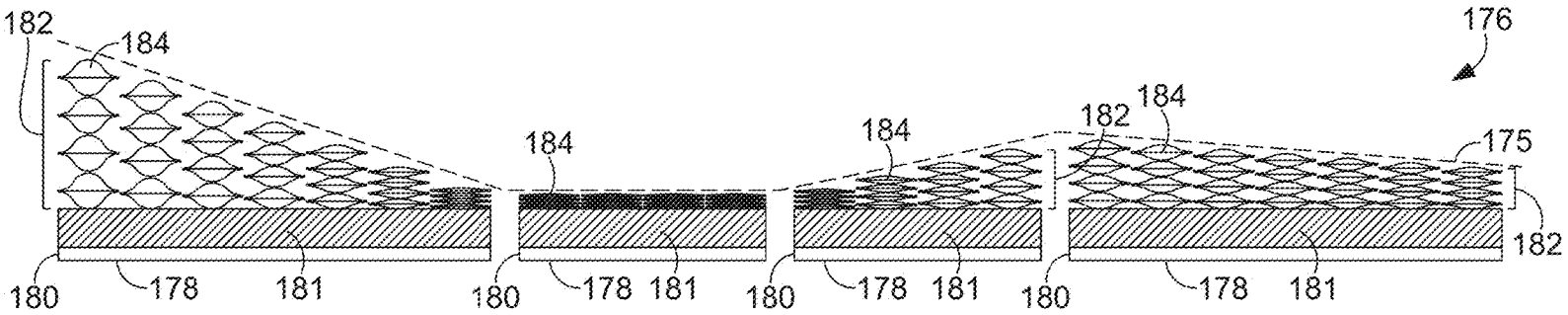
FIG. 7 is an apparatus having multiple groupings of adjustable air bladders in separate zones for controlling the height and angular orientation of different sections of an enclosure, with the apparatus in a first configuration, in accordance with an embodiment of the present invention.
Figure 8:
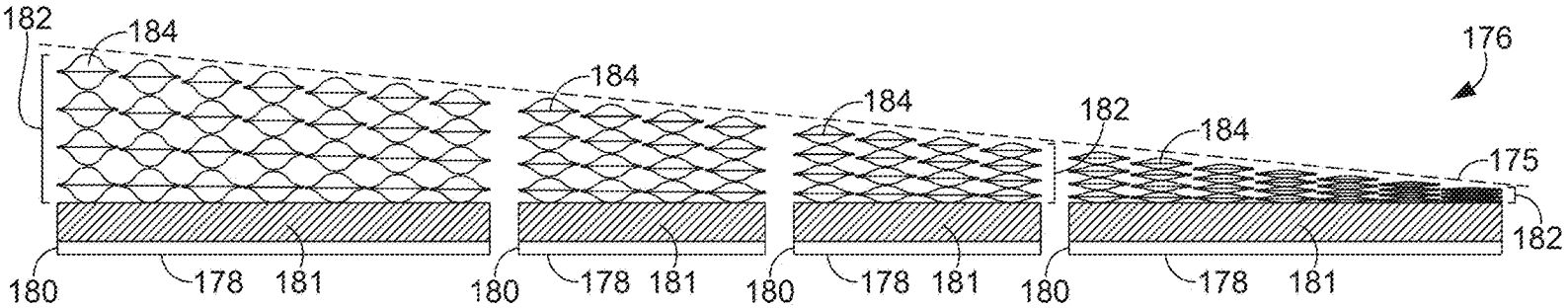
FIG. 8 is the apparatus of FIG. 7, with the air bladders in a second configuration, in accordance with an embodiment of the present invention.

In reference to FIGS. 7 and 8, an apparatus 176 having multiple groupings 182 of adjustable air bladders 184 in stacked configuration for controlling the height and angular orientation of a multi-section deck 180 within an enclosure, with the apparatus 176 in a first configuration and a second configuration, respectively, is shown, in accordance with an embodiment of the present invention. In FIG. 7, the apparatus 176 includes multiple independent bladder zones 178 each on a section of a deck 180, which may be adjustable. Each bladder zone 178 contains multiple groupings 182 of air bladders 184 in stacked configuration on top of a support layer 181. The support layer may be foam, springs, air chambers, water, or other cushioning elements. As described herein, each grouping 182 of air bladders 184 may be pneumatically coupled to a pump, supply valve, and outlet valve through a pneumatic coupling, as described in relation to FIG. 6, and may be controlled by a control device as described in relation to FIG. 6. In this regard, in response to input from a user, or in response to feedback from one or more weight sensors indicating weight or occupancy indications from sensors in different areas of the enclosure in which the apparatus 176 is incorporated, the adjustable groupings 182 of bladders 184 may be filled or emptied with pressurized air to raise and lower zones 178 of the apparatus (e.g., head, torso, thigh, and foot zones), which can, in turn, raise and lower sections of the apparatus 176 to control elevation and angular definition of a surface 175. As shown in FIG. 7, by filling bladders 184 forming the different groupings 182 with pressurized air (FIGS. 7 and 8 provide an exemplary grouping with four bladders 184 per grouping 182), the bladder groupings 182 and zones 178 can be adjusted to different heights and different angles, to provide custom adjustment for the shape and angle of the surface 175, and also to provide rolling massage by continuously increasing and decreasing the pressure in the various groupings 182 and/or zones 178. In FIG. 8, the apparatus 176 is shown with a different inflation in the bladder groupings 182 and bladder zones 178, providing a second configuration of the apparatus 176 with different heights and angular orientations of the surface 175 in relation to the first configuration shown in FIG. 7. Any other configuration is possible, with the orientations shown in FIGS. 7 and 8 being merely exemplary.

Figure 9:
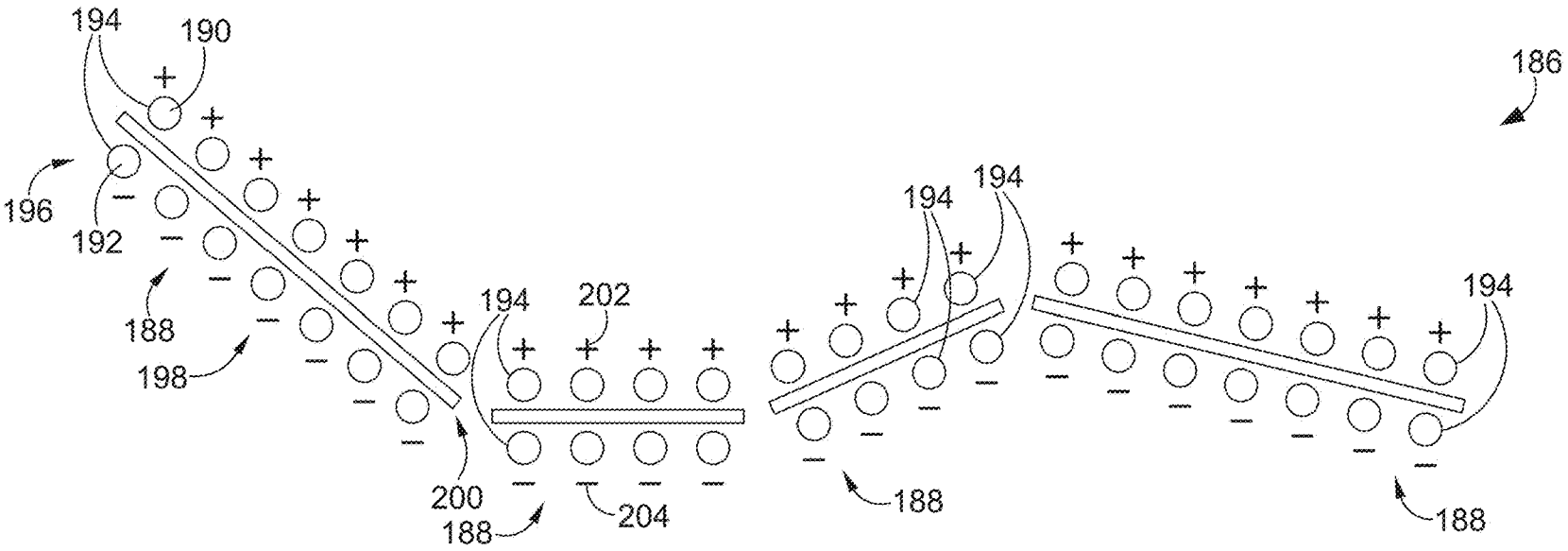
FIG. 9 is an exemplary diagram of a control interface associated with a control device used for controlling the amount of air in one or more air bladders or groupings of air bladders within an enclosure, in accordance with an embodiment of the present invention.

In reference to FIG. 9, an exemplary control interface 186 is shown, the control interface 186 used for controlling an amount of pressurized air within the adjustable air bladders, bladder groupings, or bladder zones described herein (e.g., the bladders 184, bladder groupings 182, or bladder zones 178 described in relation to FIGS. 7 and 8). This allows a user to control the level of inflation of various bladders, bladder groupings, or bladder zones manually to provide a desired elevation or angle of a surface of an enclosure. In FIG. 9, the interface 186 includes a series of controls 194 for different bladder stacks grouped into different bladder zones 188, each set of controls 194 including a pressure increase input 190 and a pressure decrease input 192, which allow a user to provide commands to increase or decrease the air pressure in the bladders associated with the bladder controls 194, raising or lowering the associated section of the enclosure. The angle and/or height elevation of each zone 188 of the control interface 186 in FIG. 9 corresponds to an angle of the enclosure corresponding to that zone 188 due to pressurization of the associated air bladders. For example, a first end 196 of a first bladder zone control 198 is shown elevated relative to a second end 200 of the first bladder zone control 198, as indicated by the downward left-to-right slope of the bladder zone control 198. This corresponds to the angular position of the corresponding portion of the enclosure.

Regarding the controls, the "+" indicator 202 indicates an increase pressure in an associated bladder grouping when the associated input is activated, and the "−" indicator 204 indicates a decrease pressure in an associated bladder grouping when the associated input is activated. In this regard, the "+" indicator 202 and the "−" indicator 204 may be used to control the massage function of the air bladders, air bladder groupings, and/or bladder zones, and/or increase or decrease the magnitude of the massage functionality in bladders associated with particular "+" and "−" controls. In embodiments, a variety of different massage actions may be controlled, actuated, or cycled through with the "+" and/or "−" controls. Exemplary massage functions may include pinpoint massage, where a particular zone of the enclosure, such as a head, torso, back, or thigh zone, may be provided with rapid, rolling, percussive, or varying massage through the increasing and decreasing of the pressure in the bladders in that particular zone. Additionally, rolling, regional, percussive, sweeping, or random massage may be provided across the enclosure or in varying or selected sections to an occupant by controlling the inflation and deflation of bladders, bladder groupings, and bladder zones, or by initiating a preprogrammed massage function that inflates and deflates the bladders, bladder groupings, or bladder zones in set patterns. The "+" and "−" features may be used to control the massage magnitude, as well.

The interface in FIG. 9 is merely one exemplary interface, and additional interfaces with buttons, touch screen functionality, or interfaces utilizing smart tablets or phones, or having display screens, sliders, or voice activated controls are possible and contemplated, and any connection between the control device, the associated interface, and the components that are being controlled (e.g., air pump, bladders, bladder groupings, bladder zones, etc.) may be included, including both hard wired and/or wireless controls.

Figure 10:
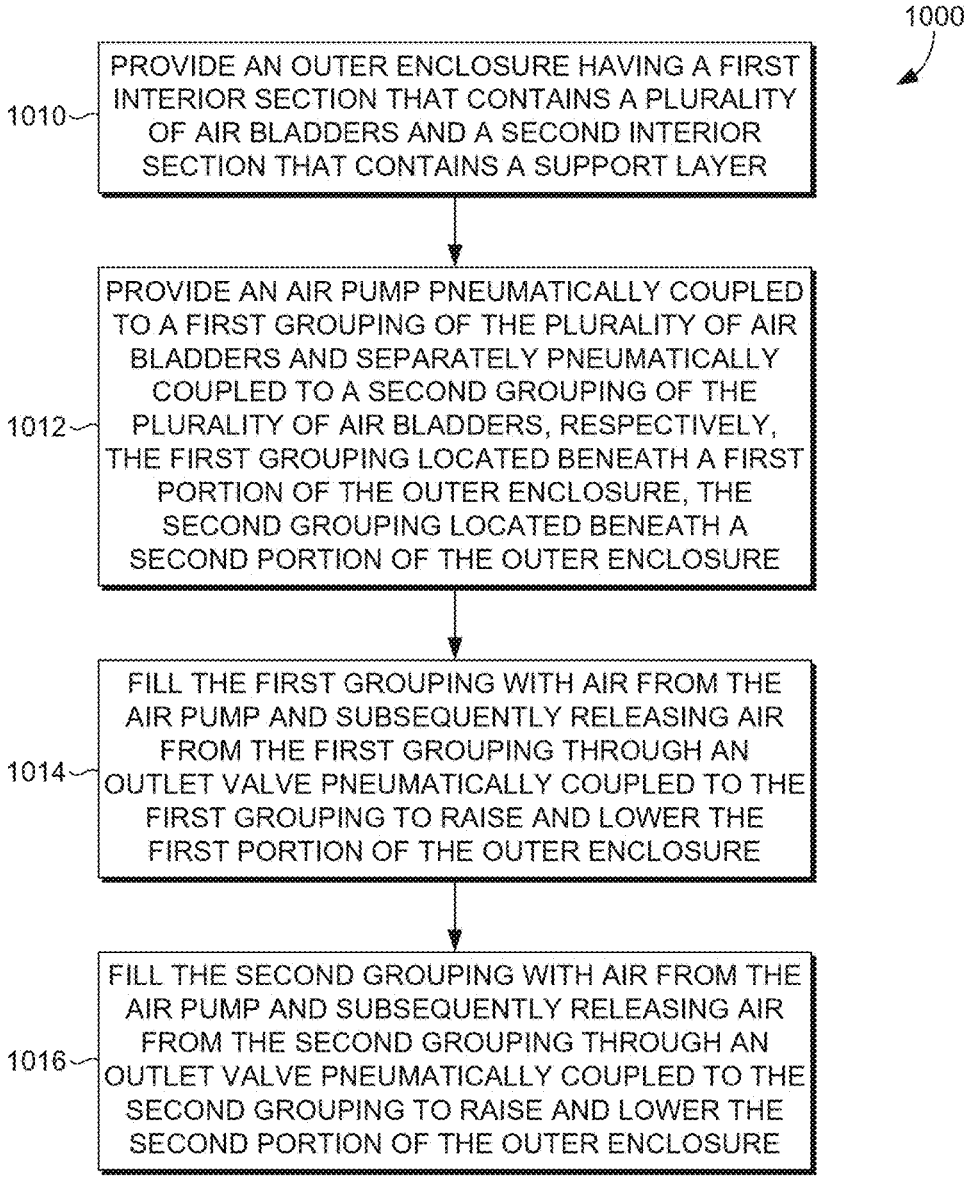
FIG. 10 is a flow diagram of an exemplary method of providing rolling massage, in accordance with an embodiment of the present invention.

In reference to FIG. 10, a flow diagram of an exemplary method 1000 for providing rolling massage is shown, in accordance with an embodiment of the present invention. In FIG. 10, at a first block 1010, an outer enclosure, such as the outer enclosure 102 shown in FIG. 2, having a first interior section that contains a plurality of air bladders, such as the air bladders 106 shown in FIG. 2, and a second interior section that contains a support layer, such as the support layer 126 shown in FIG. 4, is provided. At a second block 1012, an air pump, such as the air pump 170 shown in FIG.

6, is pneumatically coupled to a first grouping of the plurality of air bladders, such as the first grouping 161 in FIG. 6, and is separately pneumatically coupled to a second grouping of the plurality of air bladders, such as the second grouping 162 in FIG. 6, the first grouping located beneath a first portion of the outer enclosure, the second grouping located beneath a second portion of the outer enclosure. At a third block 1014, the first grouping is filled with air from the air pump and air is subsequently released from the first grouping through an outlet valve, such as the outlet valve 166 in FIG. 6, pneumatically coupled to the first grouping to raise and lower the first portion of the outer enclosure. At a fourth block 1016, the second grouping is filled with air from the air pump and air is subsequently released from the second grouping through an outlet valve pneumatically coupled to the second grouping to raise and lower the second portion of the outer enclosure. This process can be repeated to provide a rolling massage effect for a person resting on the enclosure, due to the raising and lowering of different parts of the enclosure. This process can be alternated and repeated continuously. Rolling massage is merely one example of a massage function that can be performed with the apparatus described herein, and other types of massage are available and easily customizable by controlling (i.e., inflating and deflating) bladders in different locations in an enclosure to provide varying pressures and pressure patterns against an occupant resting on the enclosure. These patterns may be selectable, customizable, or random, or targeted to particular zones, to provide any number of massage types, patterns, and intensities for an occupant resting on the enclosure. Furthermore, the integration of the air bladders with a flat configuration in a deflated state allows integration of massage functionality without removing the traditional support components of an enclosure or altering the shape of an enclosure when the bladders are in an uninflated state.

Figure 11:
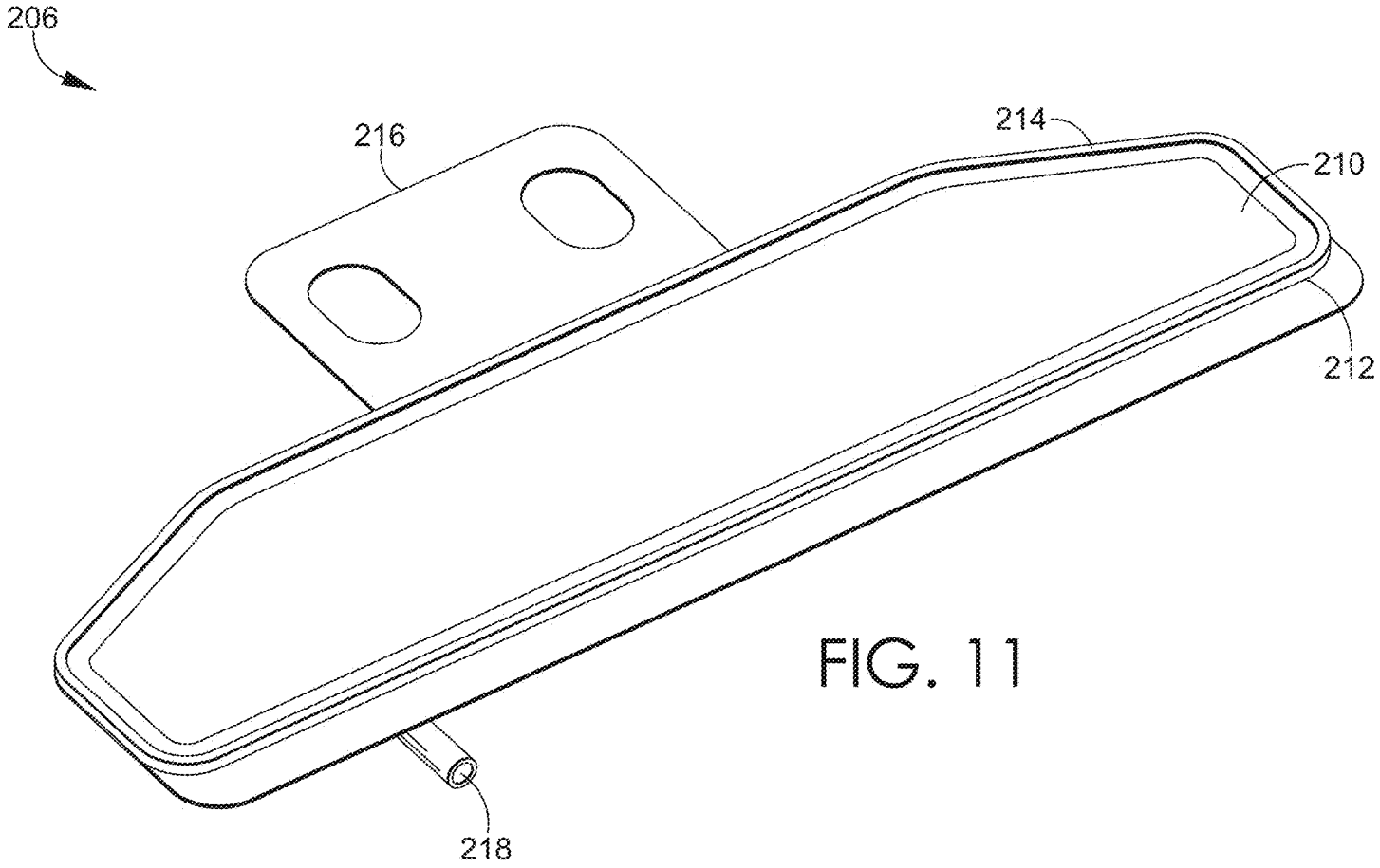
FIG. 11 is a perspective view of an exemplary air bladder for use in an enclosure, in accordance with an embodiment of the present invention.

In reference to FIG. 11, a perspective view of an exemplary air bladder 206 for use in an enclosure, such as the enclosure 102 shown in FIG. 2, or with an air bladder apparatus, such as the air bladder apparatus 158 shown in FIG. 6, is shown, in accordance with an embodiment of the present invention. In FIG. 11, the bladder 206 is formed from a first half 210 of bladder material and a second half 212 of bladder material that are joined together at edges 214. The bladder 206 includes a securing element 216 for securing the bladder 206 in position within an enclosure. The bladder 206 further includes a pneumatic coupling 218 through which pressurized air from an air pump can be introduced to an interior of the bladder 206 which is airtight, or through which pressurized air may be released from the interior of the air tight bladder. Multiple shapes, widths, size, thicknesses, and pressure capacities may be provided for the bladders, depending on the desired performance characteristics and pressure characteristics of the bladders. In embodiments, the bladder 206 may be formed from two sheets of plastic or polymer material and joined at the edges 214 with sonic welding, pressure welding, heat welding, or adhesive, stitching, or some other joining method. The bladders may also be formed from a single piece of material. Such a configuration allows the bladders to have pointed sides, rather than rounded sides, providing a flatter profile. In this embodiment, the bladder 206 will lay flat when not inflated so that when it is inside an enclosure, it is less detectable by a person seated or laying on the enclosure.

The flatter profile of this embodiment allows multiple layers of bladders to be stacked one on top of the other without changing the overall profile of the mattress. Bladders arranged in this manner may be positioned inside a layer of foam and be undetectable while in the uninflated condition. There would be no visible lump from the exterior of the mattress. The flexible plastic or polymer within foam layers may also provide the same feel as a solid foam layer. By stacking the low profile bladders one on top of the other, the vertical extension of the inflated bladders may be enhanced. Therefore, this embodiment provides both advantages of being undetectable while uninflated and having a maximum vertical extension while inflated.

Additionally, the pressure, rate, and/or flow volume of pressurized air provided to or released from the air bladders, selected groupings of air bladders, and/or zones of air bladders within an enclosure may be varied to inflate or deflate the air bladders at different speeds, raising and lowering the corresponding areas or sections of the enclosure at different speeds or rates. This can be varied and controlled by a control device to provide varying intensities and patterns of massage for an occupant resting on the outer enclosure. Additionally, the supply and release of air may be varied by adjusting or controlling the degree to which the pneumatically coupled supply and release valves are opened. In this regard, the speed of inflation/deflation and the corresponding raising and lowering of the enclosure may be customized, using the control system. In various embodiments, the apparatus may provide an infinite firmness adjustment, customizable contour adjustment, customizable zone support adjustment, and/or full body massage with customizable zones, speeds, and patterns of inflation/deflation.

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. An adjustable air bladder apparatus, the apparatus comprising:

an outer enclosure;

a first interior section enclosed within the outer enclosure that contains a plurality of air bladders;

a second interior section enclosed within the outer enclosure that contains a support layer;

an air pump pneumatically coupled to the plurality of air bladders with at least one pneumatic coupling, wherein the air pump can independently supply pressurized air to first and second groupings of the plurality of air bladders, respectively, and wherein supplying the pressurized air to the first grouping raises a first section of the enclosure and supplying the pressurized air to the second grouping raises a second section of the enclosure;

a first supply valve and a first outlet valve pneumatically coupled to the first grouping of air bladders; and a second supply valve and a second outlet valve pneumatically coupled to the second grouping of air bladders, wherein the air pump, the first supply valve, and the second supply valve are selectively operable to provide the supply of pressurized air to the first and the second groupings of air bladders, respectively, at a first rate or at a second rate, the second rate expanding the first grouping and the second grouping more rapidly than the first rate.

2. The apparatus of claim 1, further comprising:

a control device communicatively coupled to the air pump for controlling the supply of air from the air pump to the plurality of air bladders; and a protective layer positioned between the first interior section and the second interior section, wherein the first interior section and the second interior section are stacked on top of one another within the outer enclosure and separated by the protective layer.

3. The apparatus of claim 2, further comprising:

a first one-way check valve that is pneumatically coupled to the air pump and to the first grouping of air bladders and that is communicatively coupled to the control device; and a second one-way check valve that is pneumatically coupled to the air pump and to the second grouping of air bladders and that is communicatively coupled to the control device.

4. The apparatus of claim 2, wherein the first and second outlet valves are selectively operable to release air from the first and second groupings of air bladders, respectively, at a first rate or at a second rate, the second rate deflating the first and second groupings of air bladders more rapidly than the first rate.

5. The apparatus of claim 2, further comprising a first pressure sensor coupled to the first grouping of air bladders and a second pressure sensor coupled to the second grouping of air bladders, the first and second pressure sensors configured to send pressure readings of the respective first and second groupings of air bladders to the control device.

6. The apparatus of claim 5, wherein the control device is configured to indicate an amount of air pressure in the first and second groupings of air bladders.

7. The apparatus of claim 5, wherein the control device is configured to receive input from a user to control the amount of air contained in the first and second groupings of air bladders.

8. The apparatus of claim 1, wherein at least a portion of the plurality of air bladders are arranged in one or more stacked groupings and are enclosed within a mattress.

9. An adjustable air bladder apparatus, the apparatus comprising:

an outer enclosure;

a first interior section enclosed within the outer enclosure that contains a plurality of air bladders;

a second interior section enclosed within the outer enclosure that contains a support layer, wherein the first interior section and the second interior section are distinct within the outer enclosure;

an air pump pneumatically coupled to the plurality of air bladders, wherein the plurality of air bladders are segmented into a plurality of groupings with each grouping having an independent pneumatic connection with the air pump, and wherein the air pump is configured to selectively supply pressurized air to each of the plurality of groupings through the respective independent pneumatic connections to raise and lower different portions of the outer enclosure;

a first supply valve and a first outlet valve pneumatically coupled to a first grouping of the plurality of groupings; and a second supply valve and a second outlet valve pneumatically coupled to a second grouping of the plurality of groupings, wherein the air pump, the first supply valve, and the second supply valve are selectively operable to provide the supply of pressurized air to the first and second groupings, respectively, at a first rate or at a second rate, the second rate expanding the first grouping and the second grouping more rapidly than the first rate.

10. The apparatus of claim 9, wherein each grouping of the plurality of groupings is positioned under a different area of a top of the outer enclosure.

11. The apparatus of claim 9, further comprising a control device operable for controlling a supply of pressurized air from the air pump to each of the plurality of groupings, wherein each of the plurality of groupings includes two or more air bladders in a stacked configuration, and wherein the air pump is pneumatically coupled to each grouping with a supply valve that is communicatively coupled to the control device.

12. The apparatus of claim 11, further comprising a plurality of outlet valves that are respectively pneumatically coupled to the plurality of stacked groupings, wherein the plurality of outlet valves are communicatively coupled to the control device.

13. The apparatus of claim 12, wherein the control device is configured to send control signals to each of the air pump, the supply valves including the first and second supply valves, and the outlet valves including the first and second outlet valves to independently control a level of air pressure within the plurality of stacked groupings.

14. The apparatus of claim 13, wherein the control device is wirelessly connected to the air pump, the supply valves including the first and second supply valves, and the outlet valves including the first and second outlet valves, and is configured to wirelessly control the same.

15. The apparatus of claim 11, further comprising a plurality of pressure sensors that are respectively pneumatically coupled to the plurality of groupings, wherein the control device is configured to receive a signal from each of the pressure sensors and provide an indication of an amount of pressure in each of the plurality of groupings.

16. The apparatus of claim 11, wherein the support layer includes a plurality of pocket coil springs.

17. The apparatus of claim 11, wherein the control device includes a touch interface for controlling the amount of air contained in each of the plurality of groupings.

18. A method for providing rolling massage, the method comprising:

positioning an outer enclosure having enclosed therein a first interior section that contains a plurality of air bladders and a second interior section that contains a support layer;

activating an air pump pneumatically coupled to a first grouping of the plurality of air bladders and separately pneumatically coupled to a second grouping of the plurality of air bladders, respectively, the first grouping located beneath a first portion of the outer enclosure, the second grouping located beneath a second portion of the outer enclosure;

filling the first grouping with air from the air pump and subsequently releasing air from the first grouping to raise and lower the first portion of the outer enclosure; and filling the second grouping with air from the air pump and subsequently releasing air from the second grouping to raise and lower the second portion of the outer enclosure, wherein a first supply valve and a first outlet valve are pneumatically coupled to the first grouping, and wherein a second supply valve and a second outlet valve are pneumatically coupled to the second grouping, wherein the air pump, the first supply valve, and the second supply valve are selectively operable to provide a supply of pressurized air to the first and second groupings, respectively, at a first rate or at a second rate, the second rate expanding the first grouping and the second grouping more rapidly than the first rate.

19. The method of claim 18, further comprising using a control device to control a supply of air provided from the air pump to the first and second groupings of air bladders, respectively, wherein the filling and releasing of air in the first and the second groupings occurs in a repeating fashion.

20. An adjustable air bladder apparatus, the apparatus comprising:

an outer enclosure;

a first interior section enclosed within the outer enclosure that contains a plurality of air bladders;

a second interior section enclosed within the outer enclosure that contains a support layer;

an air pump, wherein the air pump is pneumatically coupled to a first grouping of the plurality of air bladders that are positioned in a first area of the enclosure and is separately pneumatically coupled to a second grouping of the plurality of air bladders that are positioned in a second area of the enclosure, wherein the air pump is configured to selectively supply pressurized air to the first grouping to expand the first grouping and raise the first area of the outer enclosure and is configured to selectively supply pressurized air to the second grouping to expand the second grouping and raise the second area of the outer enclosure;

a first supply valve and a first outlet valve pneumatically coupled to the first grouping; and a second supply valve and a second outlet valve pneumatically coupled to the second grouping, wherein the air pump, the first supply valve, and the second supply valve are selectively operable to provide the supply of pressurized air to the first grouping and the second grouping, respectively, at a first rate or at a second rate, the second rate expanding the first grouping and the second grouping more rapidly than the first rate.

21. The apparatus of claim 20, wherein the first and second outlet valves are selectively operable to release air from the first and second groupings, respectively, at a first rate or at a second rate, the second rate deflating the first and second groupings more rapidly than the first rate.

* * * * *